US007061480B2

(12) United States Patent
Anderson et al.

(10) Patent No.: US 7,061,480 B2
(45) Date of Patent: Jun. 13, 2006

(54) IMAGE DISPLAY

(75) Inventors: Daryl Anderson, Corvallis, OR (US); John M da Cunha, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 382 days.

(21) Appl. No.: 10/136,664

(22) Filed: Apr. 30, 2002

(65) Prior Publication Data

US 2003/0201956 A1 Oct. 30, 2003

(51) Int. Cl.
*G09G 5/00* (2006.01)

(52) U.S. Cl. ..... 345/207

(58) Field of Classification Search ..... 345/44–46, 345/76, 77, 81–84, 182, 183, 207; 315/169.3
See application file for complete search history.

(56) References Cited

U.S. PATENT DOCUMENTS 3,631,411 A * 12/1971 Kosonocky ..... 365/238
3,659,159 A * 4/1972 Nagata ..... 345/3.1
4,467,325 A * 8/1984 Lustig ..... 345/207
5,786,796 A * 7/1998 Takayama et al. ..... 345/76
5,838,308 A * 11/1998 Knapp et al. ..... 345/173
6,275,205 B1 * 8/2001 Winer ..... 345/82
6,424,326 B1 * 7/2002 Yamazaki et al. ..... 345/77
6,542,138 B1 * 4/2003 Shannon et al. ..... 345/76
2001/0055008 A1 12/2001 Young et al.

FOREIGN PATENT DOCUMENTS

FR 2581228 10/1986

OTHER PUBLICATIONS

Hewlett-Packard Company patent application; U.S. Appl. No. 10/020,112; titled "Method And Apparatus For Image And Video Display"; filed Dec. 14, 2001.
European Search Report dated Feb. 03, 2005.

* cited by examiner

*Primary Examiner*—Richard Hjerpe
*Assistant Examiner*—Kevin M. Nguyen

(57) ABSTRACT

A display cell includes a light sensor, a display element coupled to light sensor; and a memory coupled to the light sensor. A display and an optically addressable display system using a display cell are provided. Methods for using a display cell are also provided.

37 Claims, 7 Drawing Sheets

IMAGE DISPLAY

INTRODUCTION

Image displays may be formed by an array of optically addressable display cells. Each cell may have a light sensor coupled to a display element such as a light emitting diode (LED) or a light valve or light controlling surface which determines whether to let a certain light pass through it or reflect from it to a viewer. A voltage and electrical ground are provided to each cell, but no circuitry or physical contacts are required to connect the display to a display controller processing image data. Instead, control information is conveyed optically by projection. The array of optically addressable display cells is scanned in a raster fashion by at least one beam of light which has a wavelength or wavelengths which may be sensed by the light sensors in the optically addressable display cells. An example of such a method and apparatus for image and video display is described in co-pending U.S. patent application Ser. No. 10/020,112, the specification of which is herein incorporated by reference.

An optically addressable display system has the advantage of not requiring the control signals for each addressable display cell to be wired into the display. The display elements in an optically addressable display system may also be constructed to use significantly less energy than a light source such as an arc lamp or an incandescent lamp which are typical of many active matrix display screens which are currently available.

Despite the many advantages of an optically addressable display system, continually brighter displays are often desired.

DETAILED DESCRIPTION OF THE PREFERRED EMBODIMENTS

Figure 1:
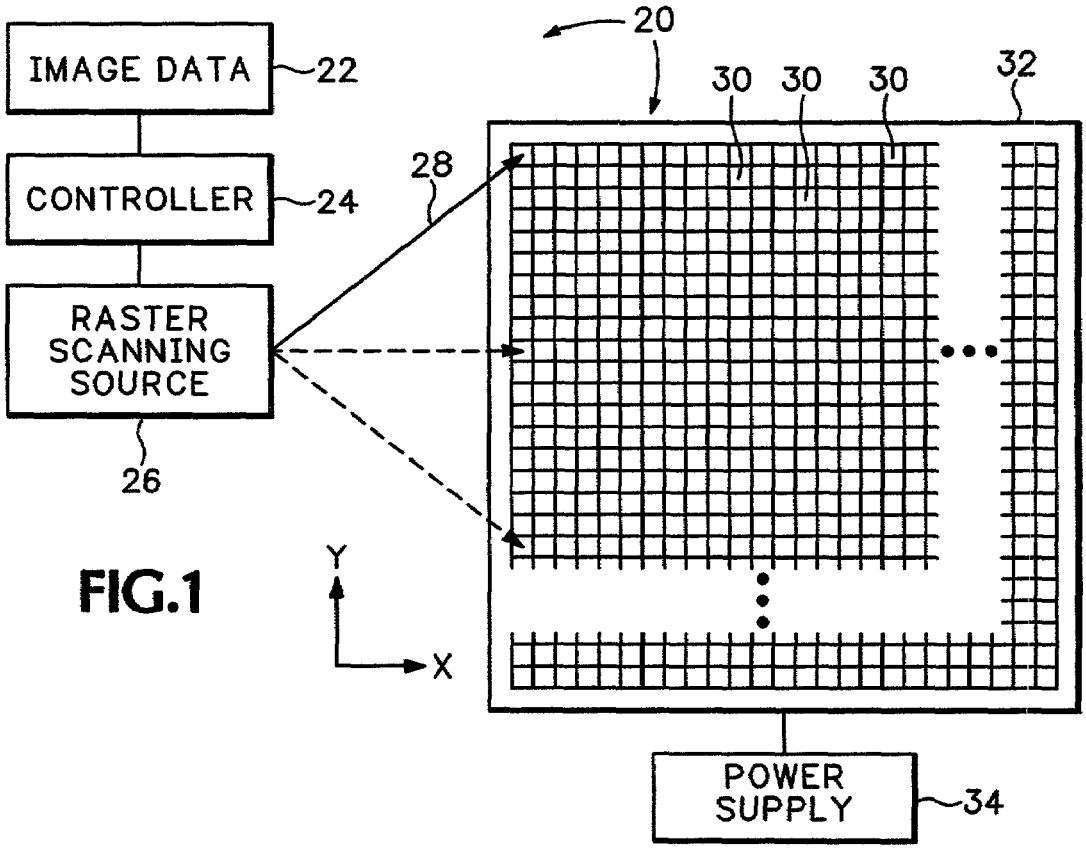
FIG. 1 is a schematic diagram illustrating one embodiment of an optically addressable display system.

FIG. 1 illustrates an optically addressable display system 20. Image data 22 is provided to a controller 24 by a linked host, such as a computer, projector, network connection, personal digital assistant, or other electronic device (not shown). The controller 24 processes the image data 22 into a format which is compatible with raster scanning source 26. Raster scanning source 26 emits at least one raster light beam 28, and can accurately direct this raster light beam 28 in the Y-axis direction, the X-axis direction, or any combination thereof, so that the raster light beam can fall onto any of the optically addressable display cells 30 which make up the display 32 of the optically addressable display system 20. The display 32 has at least one set of conductors which are configured to receive a voltage and a ground, and is connected to a power supply 34. The display 32 does not, however, need to be connected to control lines, since the control signals may be transmitted optically from the raster scanning source 26. The raster scanning source 26 can be implemented with one or more light emitting diodes or one or more laser sources, coupled with a controllable light deflecting surface or other positioning means to position the raster light beam 28 onto a desired optically addressable display cell 30. The raster scanning source 26 turns the raster light beam 28 on or off when aimed at a given optically addressable display cell 30, depending on whether there is image data 22 to display at that optically addressable display cell 30, and depending on the cell's 30 design and operation.

Figure 2:
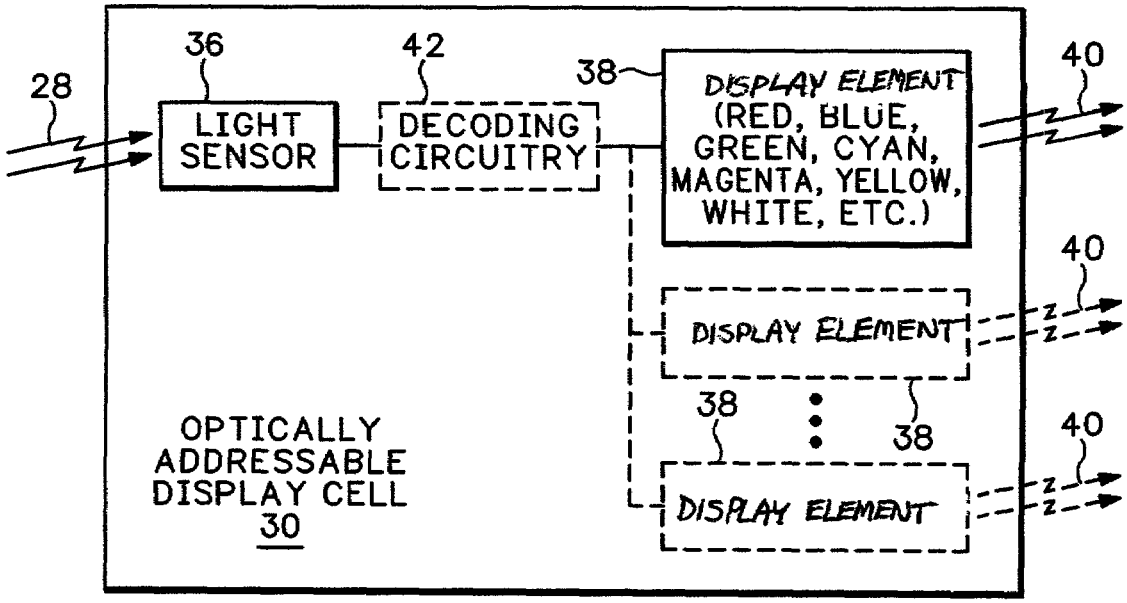
FIG. 2 is a block diagram of one embodiment of an optically addressable display cell.

FIG. 2 illustrates possible designs for an optically addressable display cell or pixel 30 with a block diagram. The optically addressable display cell 30 has a light sensor 36 which is sensitive to light from the raster light beam 28. The light sensor 36 can be constructed from a photodiode, phototransistor, or any other light sensitive component or device. The light sensor 36 is coupled to at least one display element 38. The display element 38 may be designed to emit, pass, or reflect light at any desired wavelength, for example, the display element 38 may emit, pass, or reflect light which is red, blue, green, cyan, magenta, yellow, white, infrared, or even ultra-violet. For simplicity of explanation, the display element 38 will be discussed as being constructed from a light emitting diode (LED) and therefore able to emit light, but any light generating element, controllable light reflecting element, or controllable aperture element would be acceptable provided it fit into a desired size criteria for the optically addressable display cell 30. The display element 38 or elements 38 in an optically addressable display cell 30 are designed to emit light which can be combined with light from other optically addressable display cells 30 to form an image on the display 32 which is representative of the image data 22. The optically addressable display cell 30 can be designed to emit light 40 from the display element 38 when the raster light beam 28 is positioned to activate the light sensor 36 and to not emit light 40 when there is no incident raster light beam 28. The optically addressable display cell 30 may also be designed to work in the opposite fashion, in other words: emit light 40 from display element 38 when there is no incident light 28 on the light sensor 36, and not emit light 40 when there is incident light 28 on the light sensor 36. For simplicity, this specification will describe the former case, where an incident raster light beam 28 on the light sensor 36 causes the display element 38 to emit light 40. It should be understood, however, that an inverted operation is possible and intended to be covered by this specification.

Optically addressable display cells 30 may have more than one display element 38. In this case, the raster scanning source 26 will cause a raster light beam 28 to fall on a given light sensor 36 in a manner which communicates more than one element of image data. For example, if an optically addressable display cell 30 has red, blue, and green display elements 38, and the red display element is desired on, the blue display element is desired off, and the green display element is desired on, the raster light beam may be turned on, off, and then on again during one pass of the optically addressable display cell 30. In this situation, the optically addressable display cell 30 utilizes decoding circuitry 42 to separate the raster light beam 28 "on" and "off" states detected by the light sensor 36 and route the appropriate on/off signal to the display elements 38. Although multiple display elements 38 and decoding circuitry 42 may be implemented in an optically addressable display cell 30, a cell with one display element 38 tied to the light sensor 36, will be used for the sake of simplicity and discussion.

Figure 3:
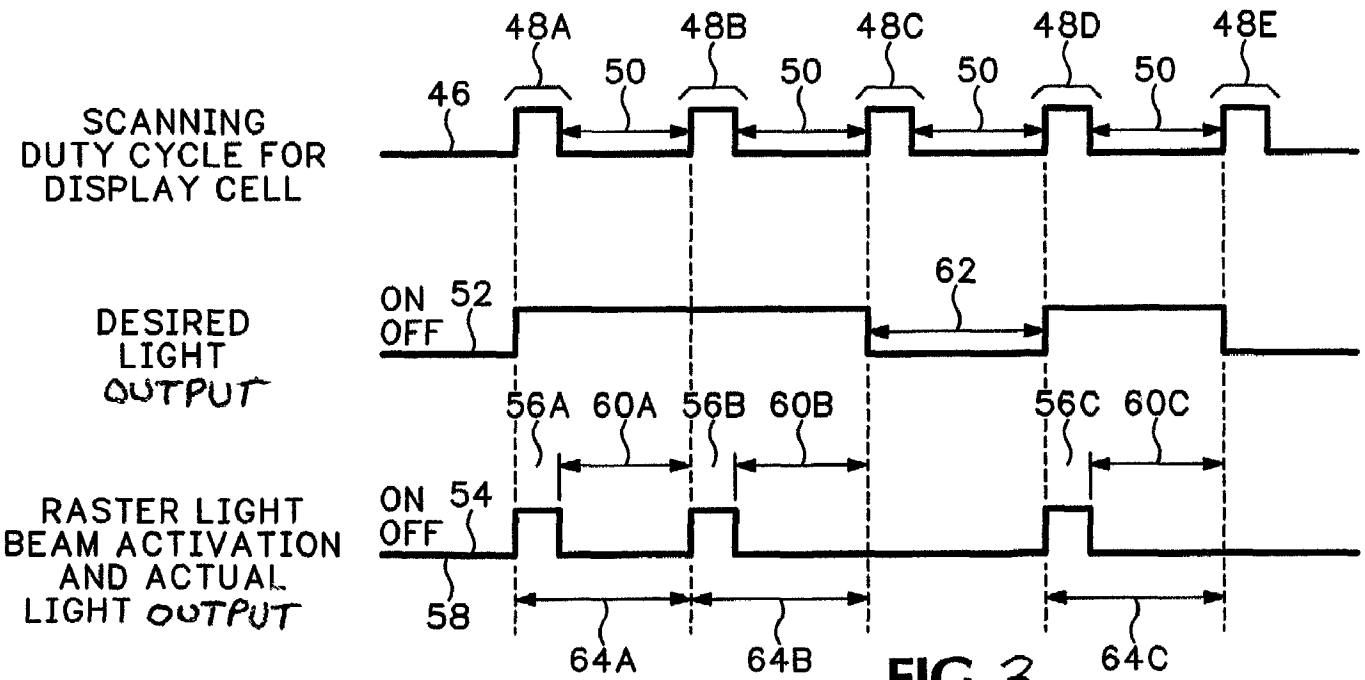
FIG. 3 is a timing diagram illustrating an example of desired light output and actual light output in one embodiment of an optically addressable display system.

FIG. 3 illustrates a timing diagram of how the optically addressable display cell 30 might operate in an optically addressable display system 20. Since the raster scanning source 26 must scan its raster light beam 28 across multiple optically addressable display cells 30, there will be a scanning duty cycle 46 for a given optically addressable display cell 30. During the active portions 48A–48E of the scanning duty cycle 46, the raster scanning source 26 has an opportunity to activate the raster light beam 28 so that it can be detected by the light sensor 36 in the optically addressable display cell 30. During the inactive portions 50 of the scanning duty cycle 46, the raster light beam 28 can not contact the optically addressable display cell 30. The controller 24 processes the image data 22 to determine the desired light output 52 for given optically addressable display cell 30 over time. The desired light output curve 52 in FIG. 3 shows that the desired light output can be either on or off.

During a given active portion 48A–48E of the scanning duty cycle 46, if the corresponding desired light output 52 should be on, then the raster light beam 28 will be activated for the duration of that corresponding scanning duty cycle active portion 48A–48E. Raster light beam activation curve 54 illustrates how this works with respect to the scanning duty cycle 46 and the desired light output 52 over time. In the example shown in FIG. 3, for the active portion 48A of the scanning duty cycle, the desired light output 52 state is on. Therefore, the raster light beam activation curve 54 shows that the raster light beam 28 is activated 56A during the active portion 48A. Since the display element 38 in the optically addressable display cell 30 of FIG. 2 is only emitting when there is incident light on the light sensor 36, the actual light output 58 graphed in FIG. 3 tracks the raster light beam activation curve 54. This results in an off period 60A where the actual light output 58 is turned off, despite the fact that the desired light output 52 is on for the same corresponding off period 60A. At the next active portion 48B of the scanning duty cycle 46, the raster scanning source 26 has an opportunity to activate the actual light output again if desired. As the example of FIG. 3 shows, the desired light output 52 is on during the active portion 48B. Thus, during active portion 48B, the raster light beam 28 is activated 56B and actual light output 58 is turned on only during the active portion 48B. Again, there is an off period 60B where the desired light output is on, but where the actual light output is off. At the next active portion, 48C of the scanning duty cycle, the raster scanning source will again have an opportunity to activate the raster light beam 28, and therefore the actual light output 58. For the active portion 48C, however, the desired light output 52 is off, so, as curve 54 shows, the raster light beam 28 is not activated during active portion 48C. Correspondingly, the actual light output 58 is off during the active portion 48C. Note that during the time frame 62, which began with active portion 48C, the actual light output 58 exactly tracks the desired light output 52. Thus, there will be no off period during the time the desired light output 52 is off, but for times when the desired light output 52 is on, there will be off periods 60A–60C when the actual light output 58 is turned off. This limited actual on-time 56A–56C, when compared to an entire duty cycle 64A–64C results in a diminished perceived brightness of the display 32.

Figure 4:
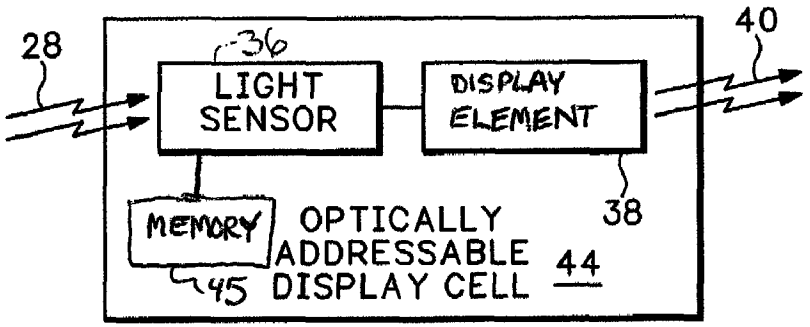
FIG. 4 is a simplified block diagram of one embodiment of an optically addressable display cell.

FIG. 4 illustrates, in block-diagram format, an embodiment of an optically addressable display cell 44 which is able to mitigate or eliminate the diminished perceived brightness in an optically addressable display system 20. The optically addressable display cell has a light sensor 36 coupled to a display element 38. A memory 45 is also coupled to the light sensor. The memory allows the display element 38 to remain turned on for a period after the light sensor 36 has stopped receiving the raster light beam 28.

Figure 5:
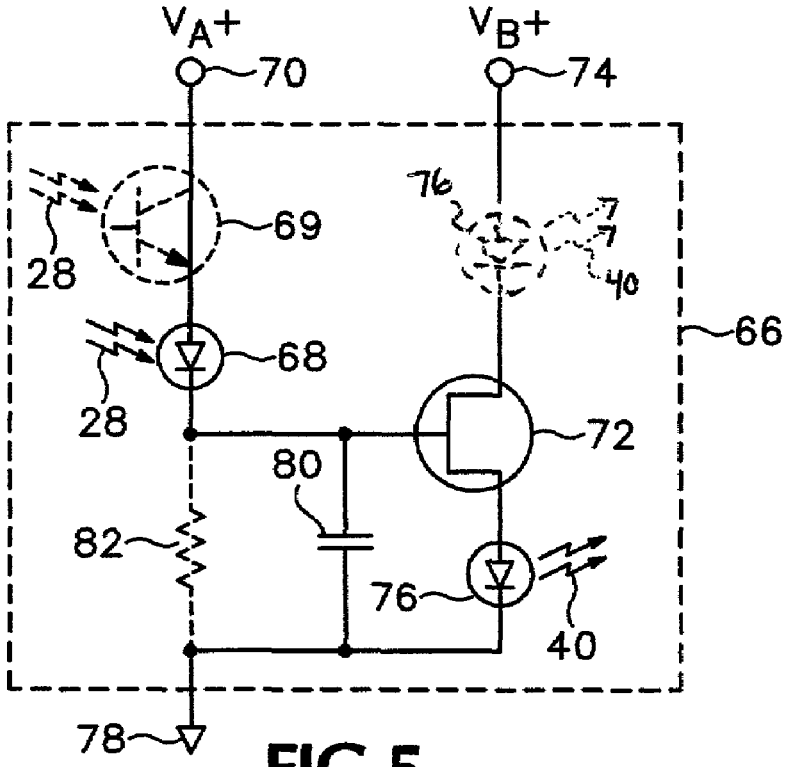
FIG. 5 illustrates a circuit for one embodiment of an optically addressable display cell.

FIG. 5 illustrates an embodiment of an optically addressable display cell 66 which is able to mitigate or eliminate the diminished perceived brightness in an optically addressable display system 20. The optically addressable display cell 66 has a light sensor which is photo diode 68. The anode of the photo diode 68 (light sensor input) is coupled to a conductor which is configured to receive a voltage, and, as shown, is connected to a first positive voltage $V_A^+$ 70. The cathode of photo diode 68 (light sensor output) is connected to the gate of a field effect transistor (FET) 72.

The photo diode 68 is a light sensor, and other types of light sensing means could be used in place of photo diode 68, for example, but not limited to, photo transistor 69. Photo transistor 69 could be used in place of photo diode 68 by removing the photo diode 68 and connecting the collector of photo transistor 69 where the anode of photo diode 68 was, and the emitter of the photo transistor 69 where the cathode of the photo diode was.

The drain of FET 72 is connected to a second positive voltage $V_B^+$ 74. $V_A^+$ 70 and $V_B^+$ 74 may be different or the same, depending on the desired implementation. The source of FET 72 is coupled to a display element, here shown as a light emitting diode (LED) 76. Specifically, the source of FET 72 is connected to the anode of the LED 76 (display element input). The cathode of LED 76 (display element output) is coupled to a conductor which is configured to receive a ground, and as shown is connected to a ground 78. An energy storage element, such as capacitor 80, is connected between the cathode of photo diode 68 and the cathode of LED 76. The capacitor 80 is an example of the memory 45 from FIG. 4. Optionally, a resistor 82 may also be connected between the cathode of photo diode 68 and the cathode of LED 76. Although this embodiment shows an FET 72, other types of transistors, such as P-type transistors, or even a relay could be used. The FET 72 is effectively a switch where the gate is like a selector, the drain is like an input, and the source is like an output. When the selector is activated, the input is connected to the output. When the selector is deactivated, the input is disconnected from the output. Those skilled in the art can appreciate that there are many switching means, for example, but not limited to various transistors and relays which can function like this type of switch. This disclosure is intended to include such functional equivalents and substitutions. Alternatively, the LED 76 could be connected on the drain side of FET 72, with the cathode of LED 76 connected to the drain of FET 72, and the anode of LED 76 connected to $V_B^+$ 74. In this case, the source of FET 72 would be connected to ground 78, and the capacitor 80 would be connected between the cathode of photo diode 68 and ground 78. In this alternate embodiment, the resistor 82 could also be connected between the cathode of photo diode 68 and ground 78.

When the raster light beam 28 illuminates the photo diode 68, the capacitor 80 is charged by current flowing through the photo diode 68. The resulting voltage on the capacitor 80 is communicated to the gate of the FET 72. This causes current to flow through the FET 72 and through the LED 76, causing the LED 76 to emit light 40. When the raster light beam 28 stops illuminating the photo diode 68, current stops flowing through the photo diode 68. The capacitor 80, however, still initially has a charge stored in it, and the FET 72 will remain on until the charge on the capacitor 80 is substantially discharged, or dissipated below the turn-on threshold for the FET 72. Once the voltage on the capacitor 80 drops below the threshold for the FET 72, the FET 72 stops conducting current and the LED 76 stops emitting.

When the photo diode 68 is off, the capacitor 80 may be discharged through the gate of FET 72 in an FET 72 selected with a controlled amount of gate leakage. The capacitor 80 may also be discharged through the optional resistor 82. The RC circuit formed by the capacitor 80 and the gate leakage of FET 72 or by the capacitor 80 and the resistor 82 is preferably designed so that the "on time" for FET 72 (and therefore the LED 76) approximately matches the length of time between scans of the raster light beam 28, or the period of time 60A shown in FIG. 3. This helps the actual light output 58 (FIG. 3) more closely resemble the desired light output 52 (FIG. 3), thereby reducing or eliminating the diminished perceived brightness.

Figure 6:
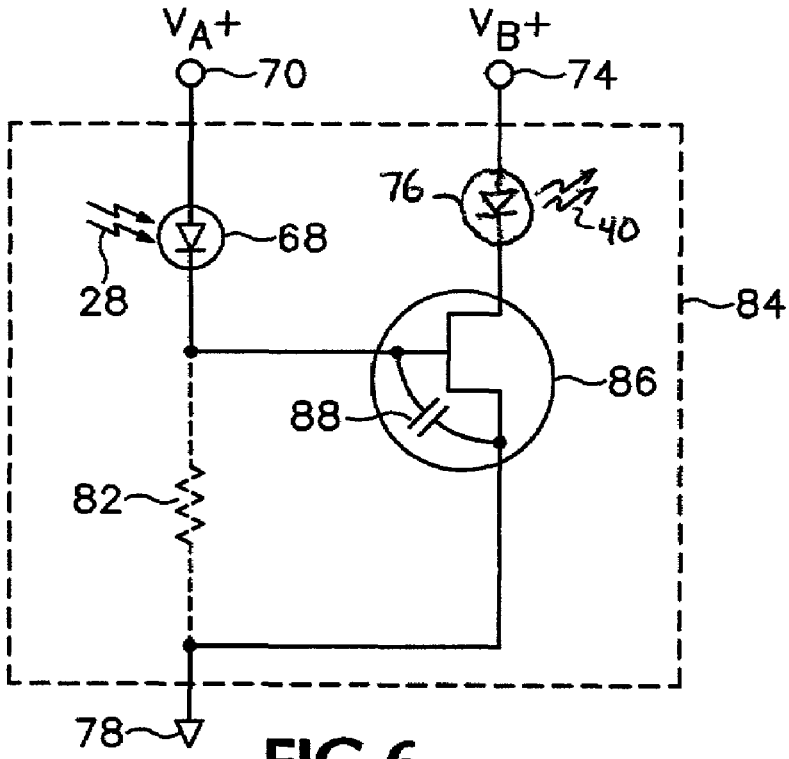
FIG. 6 illustrates a circuit for one embodiment of an optically addressable display cell.

FIG. 6 illustrates an embodiment of an optically addressable display cell 84 which is also able to mitigate or eliminate the diminished perceived brightness in an optically addressable display system 20. The optically addressable display cell 84 has a photo diode 68. The anode of the photo diode 68 is connected to a first positive voltage $V_A^+$ 70. The cathode of photo diode 68 is connected to the gate of a field effect transistor (FET) 86. The source of FET 86 is connected to a ground 78. The drain of FET 86 is connected to the cathode of a light emitting diode (LED) 76. The anode of LED 76 is connected to a second positive voltage $V_B^+$ 74. $V_A^+$ 70 and $V_B^+$ 74 may be different or the same, depending on the desired implementation. FET 86 is chosen for a particular gate capacitance 88 between the gate and the source. The gate capacitance is an example of an energy storage element, or more generally, a memory 45. Optionally, a resistor 82 may also be connected between the cathode of photo diode 68 and ground 78.

In the embodiment illustrated in FIG. 6, when the raster light beam 28 illuminates the photo diode 68, the gate capacitance 88, which takes the place of capacitor 80 from FIG. 5, is charged by current flowing through the photo diode 68. The resulting voltage on the gate capacitance 88, in FIG. 6, is present on the gate of the FET 86. This causes current to flow through LED 76 and through FET 86, causing the LED 76 to emit light 40. When the raster light beam 28 stops illuminating the photo diode 68, current stops flowing through the photo diode 68. The gate capacitance 88, however, still initially has a charge stored in it, and the FET 86 will remain on until the charge on the capacitance 88 is dissipated below the turn-on threshold for the FET 86. Once the voltage on the gate capacitance 88 drops below the threshold for the FET 86, the FET 86 stops conducting current and the LED 76 stops emitting. When the photo diode 68 is off, the gate capacitance 88 may be discharged through gate leakage of FET 86. The gate capacitance 88 may also be discharged through optional resistor 82. The RC circuit formed by the gate capacitance 88 and the resistance of FET 86 gate leakage or by the gate capacitance 88 and the resistor 82 is preferably designed so that the "on time" for FET 86 (and therefore the LED 76) approximately matches the length of time between scans of the raster light beam 28, or the period of time 60A shown in FIG. 3. This helps the actual light output 58 (FIG. 3) more closely resemble the desired light output 52 (FIG. 3), thereby reducing or eliminating the diminished perceived brightness.

Figure 7:
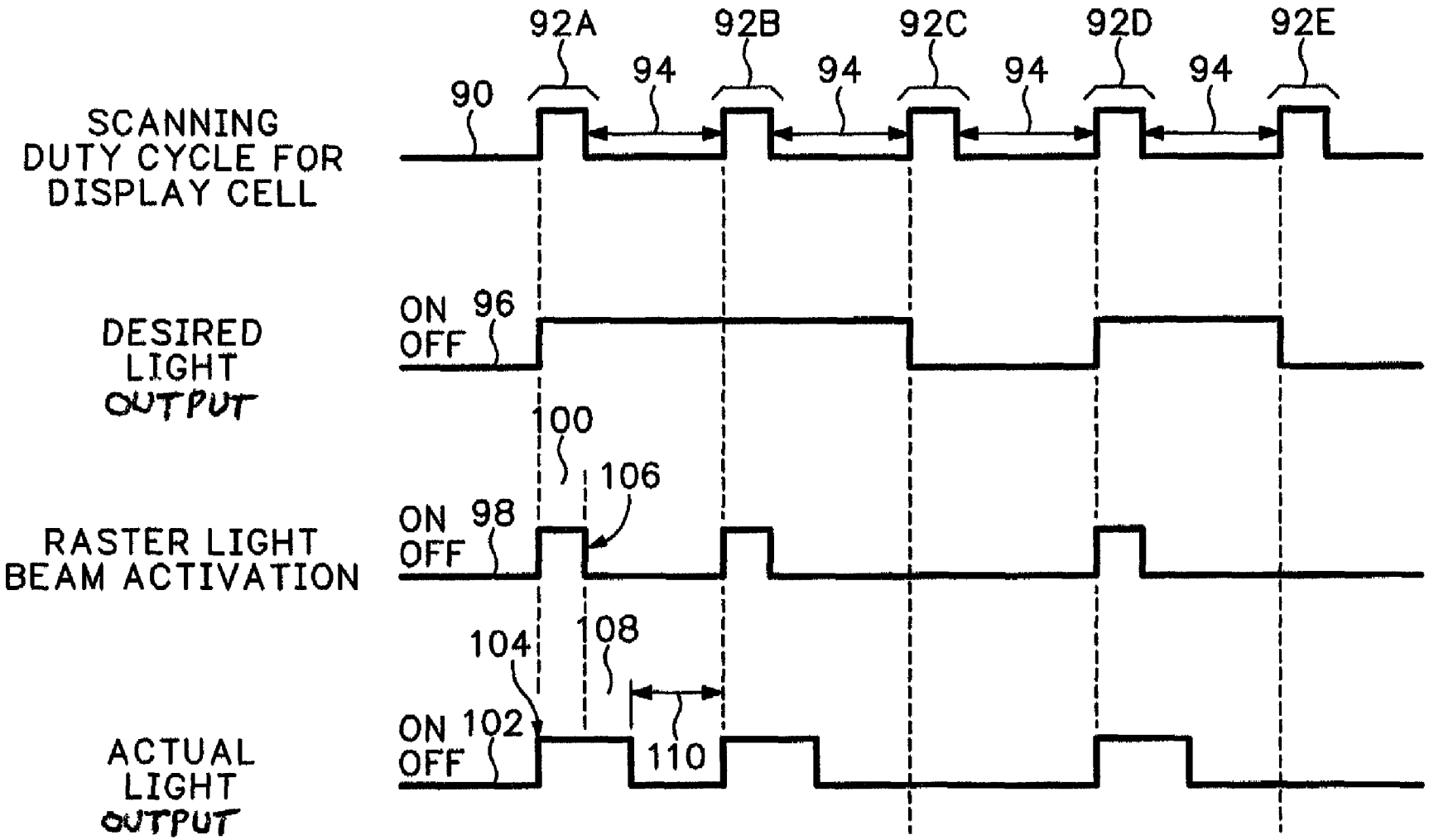
FIG. 7 is a timing diagram illustrating an example of desired light output and actual light output in one embodiment of an optically addressable display system.

FIG. 7 illustrates a timing diagram of how the optically addressable display cells 66 and 84 (from FIGS. 5 and 6) might operate in an optically addressable display system. Since the raster scanning source 26 must scan its raster light beam 28 across multiple optically addressable display cells 66, 84, there will be a scanning duty cycle 90 for a given optically addressable display cell 66, 84. During the active portions 92A–92E of the scanning duty cycle 90, the raster scanning source 26 has an opportunity to activate the raster light beam 28 so that it can be detected by the photo diode 68 in the optically addressable display cell 66, 84. During the inactive portions 94 of the scanning duty cycle 90, the raster light beam 28 can not contact the optically addressable display cell 66, 84. The controller 24 processes the image data 22 to determine the desired light output 96 for given optically addressable display cell 66, 84 over time. The desired light output 96 curve in FIG. 7 shows that the desired light output can be either on or off.

During a given active portion 92A–92E of the scanning duty cycle 90, if the corresponding desired light output 96 should be on, then the raster light beam 28 will be activated for the duration of that corresponding scanning duty cycle active portion 92A–92E. Raster light beam activation curve 98 illustrates how this works with respect to the scanning duty cycle 90 and the desired light output 96 over time. In the example shown in FIG. 7, for the active portion 92A of the scanning duty cycle, the desired light output 96 state is on. Therefore, the raster light beam activation curve 98 shows that the raster light beam 28 is activated 100 during the active portion 92A. The LED 76 in the optically addressable display cells 66, 84 of FIGS. 5 and 6 starts emitting when there is incident light on the photo diode 68, so the actual light output 102 graphed in FIG. 7 turns on 104 when the raster light beam activation curve 98 is turned on 100. The raster light beam activation curve 98 will necessarily turn off 106 at the completion of the active portion 92A of the scanning duty cycle 90. The design of the optically addressable display cells 66, 84 from FIGS. 5, 6, however, allows the actual light output 102 to remain turned on during period 108, even after the raster light beam has been turned off 106. This results in a reduced off period 110, as compared to the larger off period 60A in FIG. 4. The reduced off period 110 means that the actual light output curve 102 is more closely tracking the desired light emission curve 96. In the case of the optically addressable display cell 66 embodied in FIG. 5, the off period 110 can be reduced further, or even eliminated by choosing capacitor 80, FET 72, and optionally resistor 82 such that LED 76 remains on for a longer duration. In the case of the optically addressable display cell 84 embodied in FIG. 6, the off period 110 can be reduced further, or even eliminated by choosing FET 86 with gate capacitance 88 and optionally resistor 82 such that LED 76 remains on for a longer duration. The actual component values chosen will depend on the embodiment used and can be determined by those skilled in the art depending on the entire system parameters. The embodiments illustrated in FIGS. 5 and 6 enable a reduction of the off period 110 shown in FIG. 7. Reducing the off period 110 increases the perceived brightness of the optically addressable display system 20.

Figure 8:
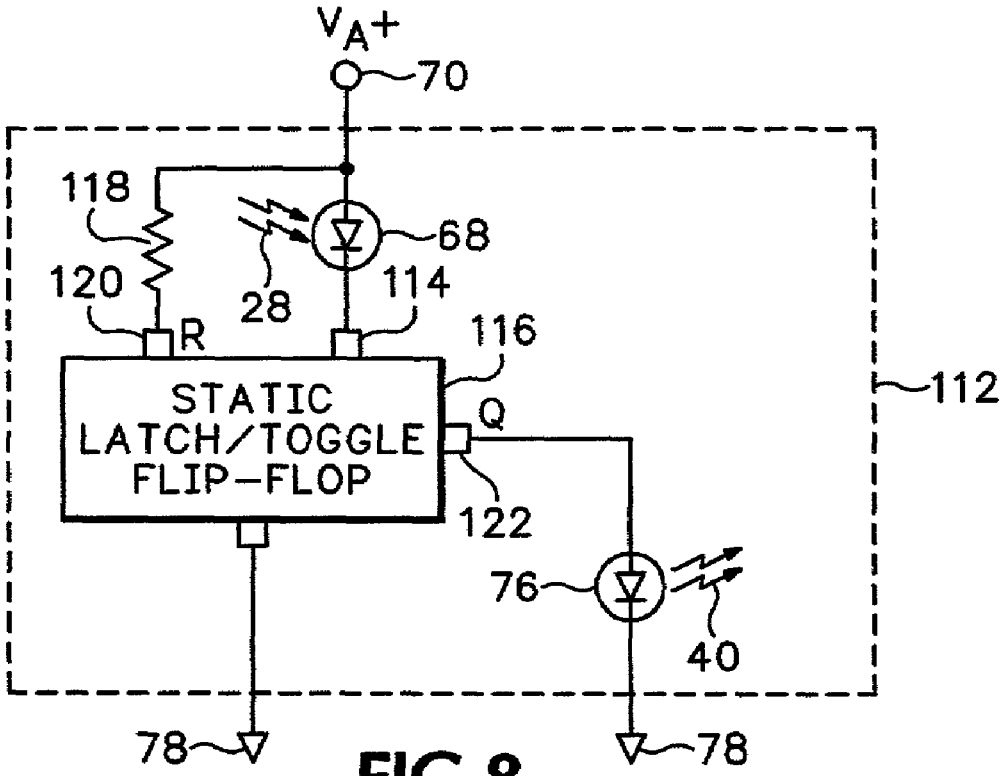
FIG. 8 illustrates a circuit for one embodiment of an optically addressable display cell.

FIG. 8 illustrates an embodiment of an optically addressable display cell 112 which, in conjunction with an appropriate process, is able to eliminate or nearly eliminate the diminished perceived brightness in an optically addressable display system 20. The optically addressable display cell 112 has a photo diode 68. The anode of the photo diode 68 is connected to a first positive voltage $V_A^+$ 70. The cathode of the photo diode 68 is connected to an input 114 of a static latch, or toggle flip-flop 116. This static latch, or state machine, is one example of the memory 45 of FIG. 4. A voltage ground 78 is connected to the toggle flip-flop 116, as well. A pull-up resistor 118 is connected between the voltage $V_A^+$ 70 and a reset point 120 on the toggle flip-flop 116. When power is initially applied to the optically addressable display cell 112, the voltage $V_A^+$ 70 will create a transitioning edge which will reset the toggle flip-flop 116 to a known state. For this embodiment to work properly, the controller 24 in the optically addressable display system 20 must always know the previous state of each optically addressable display cell 112. Providing a reset signal to each cell 112 assures that the controller 24 will know the starting state for each cell 112. Although the reset point 120 on the toggle flip-flop 116 is illustrated as being controlled from a pull-up resistor 118 connected to the voltage $V_A^+$ 70, there are other ways to provide this signal which will be apparent to those skilled in the art. This specification is intended to cover these functionally equivalent methods of providing a reset signal, including, but not limited to, pull-down connections and a separate reset line from the controller 24 to all of the optically addressable display cells 112.

An output 122 of the toggle flip-flop 116 is connected to the anode of the LED 76, and the cathode of LED 76 is connected to ground 78. This embodiment requires that the output 122 of the toggle flip-flop 116 is sufficient to drive the LED 76 when the voltage at the output 122 is active. Other means for toggling an output with an input will be apparent to those skilled in the art, and may be implemented in lieu of the toggle flip-flop 116, including, but not limited to discrete logic component flip-flop equivalents. Such state machines, and means for toggling an output with an input are intended to be covered by this specification.

At the level of the optically addressable display cell 112, operation occurs as follows: Since a toggle flip-flop 116 is involved, knowledge of the previous flip-flop state is required. For the sake of explanation, the previous state of the output 122 will be off. When the raster light beam 28 contacts the photo diode 68, the photo diode 68 will conduct current. This creates a positive voltage transition at the input 114 of the toggle flip-flop 116. The positive voltage transition causes the toggle flip-flop 116 to change the state of the output 122 from off to on. The voltage created at the output 122 in the on state causes current to flow in the LED 76, thereby causing it to emit light 40. When the raster light beam 28 ceases to contact the photo diode 68, the photo diode 68 will stop conducting current. This causes a negative voltage transition at the input 114 of the toggle flip-flop 116. The toggle flip-flop 116 does not react to a negative voltage transition, so the output 122 remains on, and the LED 76 remains on. The LED 76 will remain turned on until the raster light beam 28 is incident on the photo diode 68 again. When the raster light beam 28 falls on the photo diode 68 the next time, the photo diode 68 will begin to conduct current. This creates a positive voltage transition at the input 114 of the toggle flip-flop 116. The positive voltage transition causes the toggle flip-flop 116 to change the state of the output 122 from on to off. Since there is no voltage at the output 122, no current flows through the LED 76, and no light is emitted from the LED 76.

It should be apparent that a flip-flop could be chosen to react to a negative voltage transition instead of a positive voltage transition, as such modifications are within the abilities of those skilled in the art. Such equivalents are intended to be within the scope of this specification. Based on the preceding explanation of the operation of the optically addressable display cell 112, with toggle flip-flop 116, it is possible to describe a process the controller 24 could use in conjunction with this type of optically addressable display cell 112. First, however, an additional embodiment of an optically addressable display cell is described, since both cells can be used with such a process.

Figure 9:
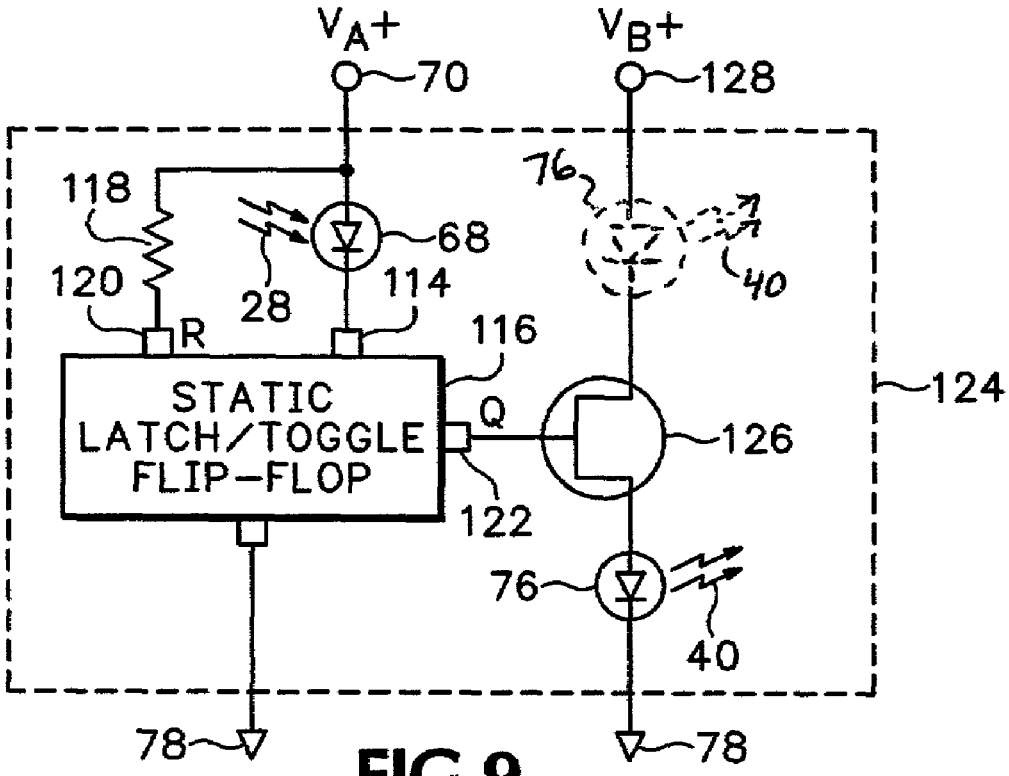
FIG. 9 illustrates a circuit for one embodiment of an optically addressable display cell.

FIG. 9 illustrates an embodiment of an optically addressable display cell 124 which, in conjunction with an appropriate process, is able to eliminate or nearly eliminate the diminished perceived brightness in an optically addressable display system 20. The optically addressable display cell 124 has a photo diode 68. The anode of the photo diode 68 is connected to a first positive voltage $V_A^+$ 70. The cathode of the photo diode 68 is connected to an input 114 of a static latch, or toggle flip-flop 116. This static latch, or state machine, is one example of the memory 45 of FIG. 4. A voltage ground 78 is connected to the toggle flip-flop 116. A pull-up resistor 118 is connected between the voltage $V_A^+$ 70 and a reset point 120 on the toggle flip-flop 116. When power is initially applied to the optically addressable display cell 124, the voltage $V_A^+$ 70 will create a transitioning edge which will reset the toggle flip-flop 116 to a known state. For this embodiment to work properly, the controller 24 in the optically addressable display system 20 must always know the previous state of each optically addressable display cell 124. Providing a reset signal to each cell 124 assures that the controller 24 will know the starting state for each cell 124. Although the reset point 120 on the toggle flip-flop 116 is illustrated as being controlled from a pull-up resistor 118 connected to the voltage $V_A^+$ 70, there are other ways to provide this signal which will be apparent to those skilled in the art. This specification is intended to cover these functionally equivalent methods of providing a reset signal, including, but not limited to, pull-down connections and a separate reset line from the controller 24 to all of the optically addressable display cells 124.

The output 122 of the toggle flip-flop 116 is connected to the gate of FET 126. The drain of FET 126 is connected to a second voltage $V_B^+$ 128. The source of the FET 126 is connected to the anode of the LED 76, and the cathode of LED 76 is connected to ground 78. This embodiment requires that the output 122 of the toggle flip-flop 116 is sufficient to turn on the FET 126 when the voltage at the output 122 is active. When the FET 126 is turned on, current will flow from $V_B^+$ 128 through the LED 76, and light 40 will be emitted. The use of an FET 126 in this embodiment, as opposed to the embodiment shown in FIG. 8 which does not have an FET, allows the LED 76 to be driven by a different voltage than that which supplies the toggle flip-flop 116, thereby allowing $V_A^+$ 70 and $V_B^+$ 128 to be different or, if $V_A^+$ 70 and $V_B^+$ 128 are the same, to at least avoid loading the toggle flip-flop 116 with the current which will pass through LED 76. Although this embodiment shows an FET 126, other types of transistors, such as p-type transistors, or even a relay could be used. The FET 126 is effectively a switch where the gate is like a selector, the drain is like an input, and the source is like an output. When the selector is activated, the input is connected to the output. Those skilled in the art can appreciate that there are many switching means, for example, but not limited to various transistors and relays which can function like this type of switch. This disclosure is intended to include such functional equivalents and substitutions. Alternatively, the light emitter 76 could be connected on the drain side of FET 126, with the cathode of LED 76 connected to the drain of FET 126, and the anode of LED 76 connected to $V_B^+$ 128. In this case, the source of FET 126 would be connected to ground 78.

At the level of the optically addressable display cell 124, operation occurs as follows: Since a toggle flip-flop is involved, knowledge of the previous flip-flop state is required. For the sake of explanation, the previous state of the output 122 will be off. When the raster light beam 28 contacts the photo diode 68, the photo diode 68 will conduct current. This creates a positive voltage transition at the input 114 of the toggle flip-flop 116. The positive voltage transition causes the toggle flip-flop 116 to change the state of the output 122 from off to on. The voltage created at the output 122 in the on state causes the FET 126 to turn on. When FET 126 turns on, current flows in LED 76, thereby causing it to emit light 40. When the raster light beam 28 ceases to contact the photo diode 68, the photo diode 68 will stop conducting current. This causes a negative voltage transition at the input 114 of the toggle flip-flop 116. The toggle flip-flop 116 does not react to a negative voltage transition, so the output 122 remains on, the FET 126 remains on, and the LED 76 remains on. The LED 76 will remain turned on until the raster beam light 28 is incident on the photo diode 68 again. When the raster beam light 28 falls on the photo diode 68 the next time, the photo diode 68 will begin to conduct current. This creates a positive voltage transition at the input 114 of the toggle flip-flop 116. The positive voltage transition causes the toggle flip-flop 116 to change the state of the output 122 from on to off. Since there is no voltage at the output 122, the FET 126 turns off. When FET 126 is turned off, no current flows through the LED 76, and no light is emitted from the LED 76.

It should be apparent that a flip-flop could be chosen to react to a negative voltage transition as well as a positive voltage transition, as such modifications are within the abilities of those skilled in the art. Such functional equivalents are intended to be within the scope of this specification.

Based on the preceding explanations of the operation of both optically addressable display cells 112 and 124, each using a toggle flip-flop 116, it is now possible to describe a process the controller 24 could use in conjunction with either of these optically addressable display cells 112 or 124.

Figure 10:
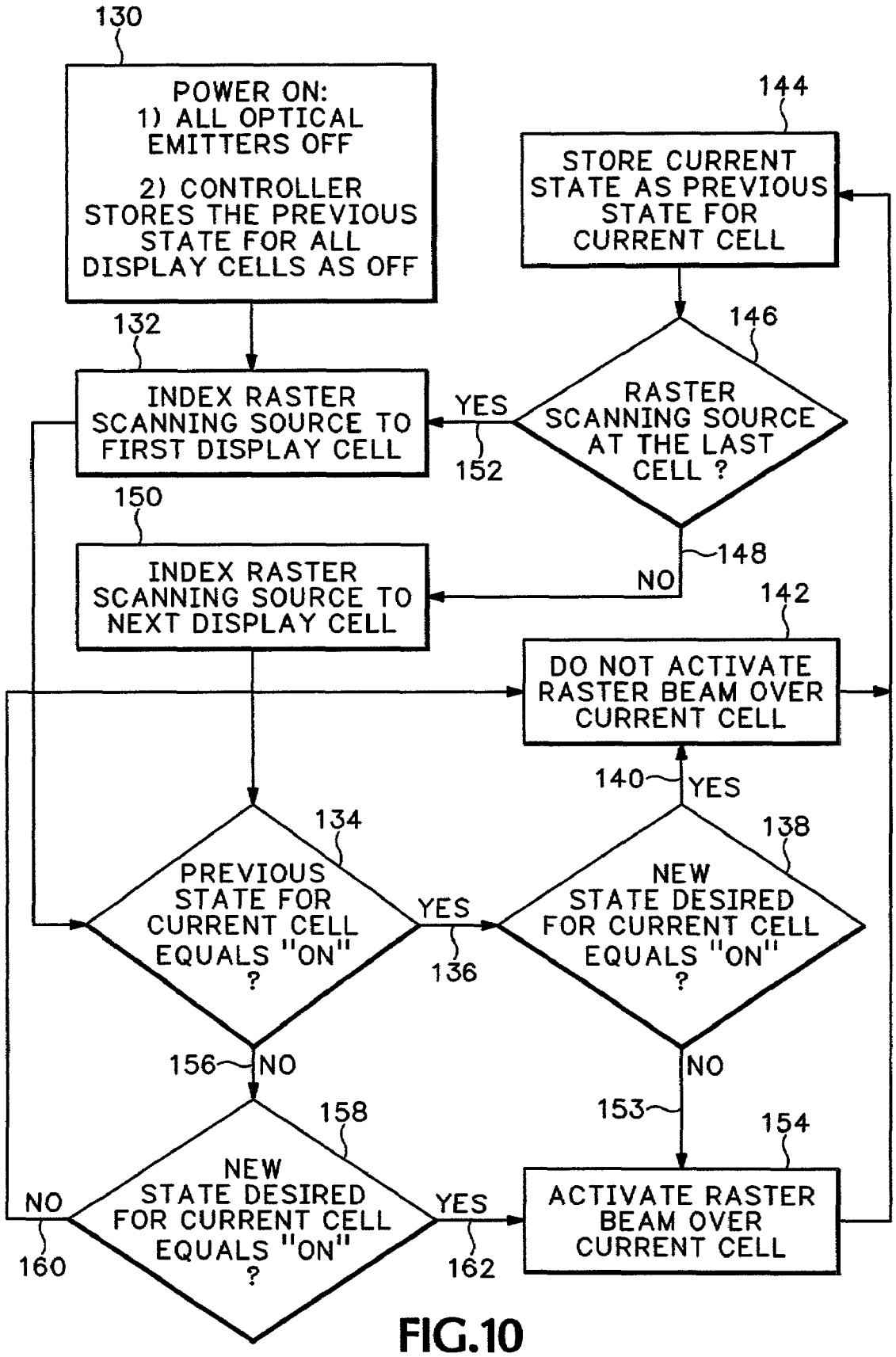
FIG. 10 illustrates a possible flow chart of actions which may be performed by an optically addressable display system.

FIG. 10 illustrates one embodiment of a process which may be used by an optically addressable display system 20 having optically addressable display cells, such as optically addressable display cells 112 and 124. The process requires, that the controller 24 know the previous state for all of the optically addressable display cells 112, 124. This is accomplished when the optically addressable display system 20 is powered on 130. At power-on 130, the described reset function of the optically addressable display cells 112, 124 ensures that all of the LED's 76, or display elements are turned off. The controller 24 stores a corresponding value of "off" for each optically addressable display cell 112, 124. All of the optically addressable display cells 112, 124 in the optically addressable display system 20 will be scanned in turn by the raster scanning source 26. After power-on 130, the process begins by indexing 132 the raster scanning source to the first optically addressable display cell. The optically addressable display cell onto which the raster scanning source is indexed is the "current cell". The controller examines 134 the previous state for the current cell. If the previous state for the current cell is "on" 136, the controller examines 138 the new state desired for the current cell. If the new state is desired to remain "on" 140, the raster light beam will not be activated 142 over the current cell, thus allowing the current cell to remain on as in its previous state. The current state is stored 144 as the previous state of the current cell. The processor then decides 146 if the raster scanning source is at the last optically addressable display cell in the optically addressable display system 20. If the raster scanning source is not 148 at the last optically addressable display cell, the raster scanning source is indexed 150 to a next optically addressable display cell. If the raster scanning source had been 152 at the last optically addressable display cell, the raster scanning source would have been indexed 132 to the first optically addressable display cell. After either indexing the raster scanning source to the first cell 132 or indexing the raster scanning source to the next cell 150, there, are four possible paths through the process until the point where the controller stores the current state as the previous state for the cell 144. One path has already been described, where the previous state for a cell was "on" 136 and the desired new state is also "on" 140. A second path is where the previous state for a cell was "on", but the desired new state for the cell is "off". In this case, after indexing the raster scanning source 132, 150 the controller examines 134 the previous state for the current cell. If the previous state for the current cell is "on" 136, the controller examines 138 the new state desired for the current cell. If the new state is desired to remain "off" 153, the raster light beam will be activated 154 over the current cell, thus allowing the current cell to change from on to off. The current state is stored 144 as the previous state of the current cell, and the process continues as already described. A third path is where the previous state for a cell was "off", and the desired new state for the cell is "off". In this case, after indexing the raster scanning source 132, 150 the controller examines 134 the previous state for the current cell. If the previous state for the current cell is "off" 156, the controller examines 158 the new state desired for the current cell. If the new state is desired to remain "off" 160, the raster light beam will not be activated 142 over the current cell, thus allowing the current cell to remain off. The current state is stored 144 as the previous state of the current cell, and the process continues as already described. A fourth path is where the previous state for a cell was "off", but the desired new state for the cell is "on". In this case, after indexing the raster scanning source 132, 150 the controller examines 134 the previous state for the current cell. If the previous state for the current cell is "off" 156, the controller examines 158 the new state desired for the current cell. If the new state is desired to change to "on" 162, the raster light beam will be activated 154 over the current cell, thus allowing the current cell to change from off to on. The current state is stored 144 as the previous state of the current cell, and the process continues as already described.

Although the process illustrated in FIG. 10 evaluates the previous state 134 for the current cell before evaluating 138, 158 the desired new state for the current cell, a process could clearly be set up to evaluate the desired new state for the current cell before the previous state. The decision to activate the raster light beam can also be looked at as the logical exclusive-or (XOR) comparison of the desired new state and the previous state of the current cell.

Figure 11:
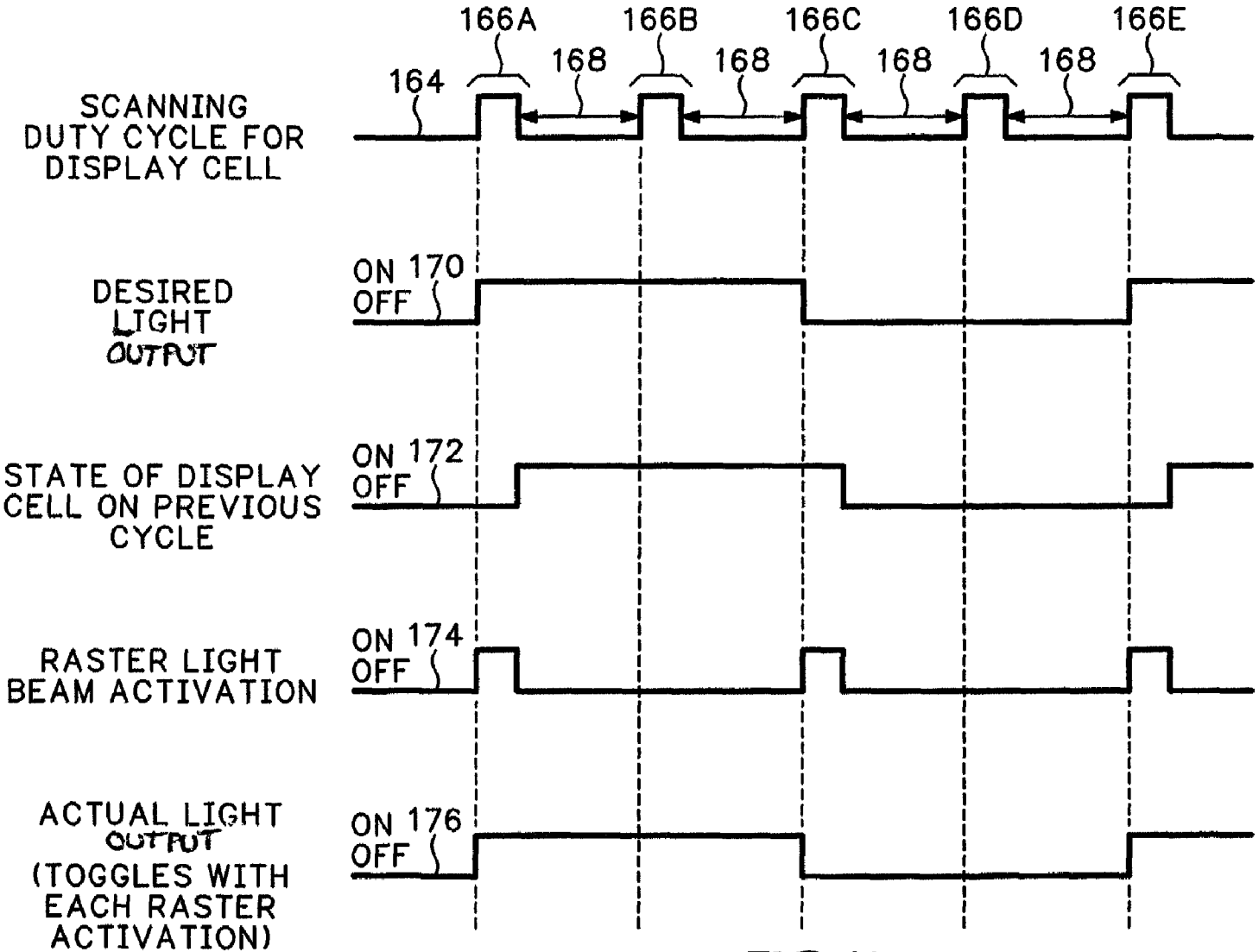
FIG. 11 is a timing diagram illustrating an example of desired light output and actual light output in one embodiment of an optically addressable display system.

FIG. 11 illustrates a possible timing chart for an optically addressable display system 20 which has optically addressable display cells, like the cells 112 or 124 in FIGS. 8 and 9 with a toggle flip-flop 116, and utilizing a process like the one illustrated in FIG. 10. Since the raster scanning source 26 must scan its raster light beam 28 across multiple optically addressable display cells 112, 124, there will be a scanning duty cycle 164 for a given optically addressable display cell 112, 124. During the active portions 166A–166E of the scanning duty cycle 164, the raster scanning source 26 has an opportunity to activate the raster light beam 28 so that it can be detected by the photo diode 68 in the optically addressable display cell 112, 124. During the inactive portions 168 of the scanning duty cycle 164, the raster light beam 28 can not contact the optically addressable display cell 112, 124. The controller 24 processes the image data 22 to determine the desired light output 170 for given optically addressable display cell 112, 124 over time. The desired light output 170 curve in FIG. 11 shows that the desired light output can be either on or off.

For a given active portion 166A–166E of the scanning duty cycle 164, the controller 24 compares the state of the optically addressable display cell on the previous cycle 172 with the desired light output state 170. In order to implement the process illustrated in FIG. 10, the controller 24 may perform an exclusive-or (XOR) comparison or the equivalent of an XOR comparison of the desired light output 170 and the state of the optically addressable display cell on the previous cycle 172 for each active portion 166A–166E of the scanning duty cycle 164. Thus, the raster light beam activation 174, during the active portions 166A–166E of the scanning duty cycle 164 is the XOR of the desired light output 170 and the state of the optically addressable display cell on the previous cycle 172. The state of the actual light output 176 toggles with each rising edge of the raster light beam activation 174. As a result, the actual light output 176 exactly or almost exactly matches the desired light output 170 intended by the controller 24. This allows the optically addressable display system 20 to operate at a high level of perceived brightness. This embodiment also has the advantage that it can work with different rates of a scanning duty cycle 164, without having to change the design of the optically addressable display cells 112, 124.

An optically addressable display system 20 allows a display 32 to be constructed with minimal or no physical control lines connecting the display 32 to the controller 24. An optically addressable display system 20 provides a brighter image with less wasted energy than conventional liquid crystal or thin-film transistor active matrix displays. In discussing various embodiments of optically addressable display systems, various other benefits have been noted above.

It is apparent that a variety of other structurally and functionally equivalent modifications and substitutions may be made to an optically addressable display system 20, display cell, or display method according to the concepts and embodiments covered herein, depending upon the particular implementation, while still falling within the scope of the claims below.

We claim:

1. A display cell, comprising:

a light sensor optically addressable within the display cell directly, without intermediary transmission, by an external raster scanning light beam;

a display element coupled to the light sensor, where the light sensor within the display cell controls the display element in response to the external raster scanning light beam; and a memory coupled to the light sensor, wherein the memory provides an "on-time" to the display element which matches a length of time between scans of the external raster scanning light beam, whereby the display element remains on until a next scan of the external raster scanning light beam.

2. The display cell of claim 1, further comprising:

a switch having a selector, an input, and an output, wherein:

the light sensor is coupled to the switch selector;

the display element is coupled to the switch input or output; and the memory comprises an energy storage element coupled to the switch selector.

3. The display cell of claim 2, further comprising a resistor coupled to the switch selector.

4. The display cell of claim 2, wherein:

the light sensor is a photo diode having a cathode and an anode; and the display element is a light emitting diode (LED) having a cathode and an anode.

5. The display cell of claim 4, wherein:

the cathode of the photo diode is coupled to the switch selector; and the anode of the LED is coupled to the switch output or the cathode of the LED is coupled to the switch input.

6. The display cell of claim 5, wherein the switch comprises a field effect transistor (FET) having a gate, a source, and a drain, wherein:

the gate is the switch selector;

the drain is the switch input; and the source is the switch output.

7. The display cell of claim 6, wherein the energy storage element is coupled between the FET gate and the FET source.

8. The display cell of claim 7, further comprising a resistor coupled between the FET gate and the FET source.

9. The display cell of claim 6, wherein the energy storage element is a gate capacitance of the FET as measured from the FET gate to the FET source.

10. The display cell of claim 9, further comprising a resistor coupled between the FET gate and the FET source.

11. The display cell of claim 2, wherein the light sensor is a photo transistor having a collector and an emitter.

12. The display cell of claim 1, wherein:

the memory comprises a state machine having an input, an output, and a reset;

the light sensor is coupled to the state machine input; and the display element is coupled to the state machine output.

13. The display cell of claim 12, wherein:

the light sensor is a photo diode having a cathode and an anode; and the display element is a light emitting diode (LED) having a cathode and an anode.

14. The display cell of claim 13, wherein:

the photo diode cathode is coupled to the state machine input; and the LED anode is coupled to the state machine output.

15. The display cell of claim 14, wherein the photo diode anode is coupled to the state machine reset.

16. The display cell of claim 1, further comprising:

a switch having a selector, an input, and an output, wherein:

the memory is a state machine having an input, an output, and a reset;

the selector is coupled to the state machine output;

the light sensor is coupled to the state machine input; and the display element is coupled to the switch input or the switch output.

17. The display cell of claim 16, wherein:

the light sensor is a photo diode having a cathode and an anode, wherein the photo diode cathode is coupled to the state machine input; and the display element is a light emitting diode (LED) having a cathode and an anode, wherein the LED anode is coupled to the switch output or wherein the LED cathode is coupled to the switch input.

18. The display cell of claim 17, wherein the switch comprises a field effect transistor (FET) having a gate, a source, and a drain, wherein:

the gate is the switch selector;

the drain is the switch input; and the source is the switch output.

19. The display cell of claim 18, wherein the photo diode anode is coupled to the state machine reset.

20. A display, comprising a plurality of display cells, at least one of the display cells comprising:

a light sensor optically addressable within the display cell directly, without intermediary transmission, by an external raster scanning light beam;

a display element coupled to the light sensor, where the light sensor within the display cell controls the display element in response to the external raster scanning light beam; and a memory coupled to the light sensor, wherein the memory provides an "on-time" to the display element which matches a length of time between scans of the external raster light beam, whereby the display element remains on until a next scan of the external raster scanning light beam.

21. The display of claim 20, wherein at least one of the display cells further comprises a switch having a selector, an input, and an output, wherein:

the light sensor has an output coupled to the switch selector; and the display element has an input and an output, wherein the display element input is coupled to the switch output or the display element output is coupled to the switch input.

22. The display of claim 20, wherein the memory comprises an energy storage element coupled to the switch selector.

23. The display of claim 22, wherein a resistor is coupled to the switch selector.

24. The display of claim 20, wherein:

the memory of at least one of the display cells comprises a state machine having an input, an output, and a reset, wherein:

the light sensor comprises an output coupled to the state machine input; and the display element comprises an input coupled to the state machine output.

25. The display of claim 24, wherein:

the light sensor is a photo diode having a cathode and an anode, wherein the photo diode cathode is the light sensor output; and the display element is a light emitting diode (LED) having a cathode and an anode, wherein the LED anode is the display element input.

26. The display of claim 20, wherein at least one of the display cells further comprises a switch having a selector, an input, and an output; wherein:

the memory composes a state machine having an input, an output, and a reset;

the display element has an input and an output, wherein the display element input is connect to the switch output, or the display element output is connected to the switch input;

the selector is coupled to the state machine output; and and the light sensor comprises an output coupled to the state machine input.

27. The display of claim 26, wherein:

the light sensor is a photo diode having a cathode and an anode, wherein the photo diode cathode is the light sensor output; and the display element is a light emitting diode (LED) having a cathode and an anode, wherein:

the LED anode is the display element input; and the LED cathode is the display element output.

28. The display of claim 27, wherein the switch comprises a field effect transistor (FET) having a gate, a source, and a drain, wherein:

the gate is the switch selector;

the drain is the switch input; and the source is the switch output.

29. An optically addressable display system, comprising:

a controller configured to receive image data;

a raster scanning source coupled to the controller, wherein the raster scanning source can generate at least one raster scanning light beam;

a display, comprising: a plurality of display cells, each comprising:

light sensing optically addressable means within each of the plurality of display cells for responding directly, without intermediary transmission, to at least one raster scanning light beam positioned externally to the display; and means for light display coupled to the light sensing means where the light sensing optically addressable means controls the means for light display in response to the at least one raster scanning light beam; and means for memory coupled to the light sensing means, wherein the means for memory provides an "on-time" to the display element which matches a length of time between scans of the at least one raster scanning light beam, whereby the display element remains on until a next scan of the external raster scanning light beam.

30. A display cell, comprising:

means for light sensing being optically addressable within the display cell directly, without intermediary transmission, by an external scanning light means;

means for light emitting coupled to the means for light sensing where the means for light sensing within the display cell controls the means for light emitting in response to the external scanning light means; and means for memory coupled to the means for light sensing, wherein the means for memory provides an "on-time" to the display element which matches a length of time between scans of the external scanning light means, whereby the display element remains on until a next scan of the external raster scanning light means.

31. A method for displaying images on an optically addressable display, comprising:

positioning a raster scanning light beam external to the optically addressable display to directly, without intermediary transmission, activate a light sensor;

charging an energy storage element upon the light sensor of the optically addressable display being activated with the raster scanning light beam;

activating a display element using the charged energy storage element;

positioning the raster scanning light beam external to the optically addressable display to directly, without intermediary transmission, deactivate the light sensor;

discharging the energy storage element; and keeping the display element on until a next scan of the raster scanning light beam.

32. The method for displaying images according to claim 31, wherein discharging the energy storage element is accomplished, in part, by leaking current through the display element.

33. The method for displaying images according to claim 32, wherein discharging the energy storage element is accomplished, in part, by leaking current through a resistor.

34. A method for displaying images using an array of optically addressable display cells each having at least one display element, comprising:

providing power to the display cells to turn each display element off;

storing a previous state for each display cell as "off" ;

optically indexing an external raster scanning source to a display cell;

determining whether a desired light output state is "on" or "off" for the display cell;

activating a raster light beam of the external raster scanning source to directly address, without intermediary transmission, the display cell if a logical exclusive-or (XOR) of the previous state for the display cell and the desired light output state for the display cell computes as "on"; and maintaining the display cell on until a next scan of the raster light beam.

35. The method for displaying images according to claim 34, further comprising:

after the determining action, storing the desired light output state as the previous state for the display cell;

after the activating action, indexing the raster scanning source to a next display cell; and repeating the determining and activating actions for an other display cell.

36. A display cell, comprising:

a field effect transistor (FET) having a gate, a source, and a drain:

a photo diode having a cathode and an anode, the photo diode responsive to an external raster scanning light beam addressed directly, without intermediary transmission, to the display cell and wherein the photo diode cathode is coupled to the FET gate;

a light emitting diode (LED) having a cathode and an anode, wherein the LED anode is coupled to the FET source or wherein the LED cathode is coupled to the FET drain;

an energy storage element coupled between the FET gate and the FET source;

a resistor coupled between the FET gate and the FET source; and maintaining the LED on until a next scan of the external raster scanning light beam.

37. A display cell, comprising:

a state machine having an input and an output;

a photo diode having a cathode and an anode, the photo diode responsive to an external raster light beam addressed directly, without intermediary transmission, to the display cell and wherein the photo diode cathode is coupled to a toggle flip-flop input;

a field effect transistor (FET) having a gate, a drain, and a source, wherein the gate is coupled to a toggle flip-flop output;

a light emitting diode (LED) having an anode and a cathode, wherein the LED anode is coupled to the FET source or wherein the LED cathode is coupled to the FET drain; and maintaining the LED on until a next scan of the external raster light beam.

* * * * *